US008460024B2

(12) United States Patent
Damodharan et al.

(10) Patent No.: US 8,460,024 B2
(45) Date of Patent: Jun. 11, 2013

(54) CONTACT ASSEMBLY FOR ELECTRICAL CONNECTOR

(75) Inventors: Kasthuri Damodharan, Harrisburg, PA (US); Michael Wilbourn, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 151 days.

(21) Appl. No.: 13/047,040

(22) Filed: Mar. 14, 2011

(65) Prior Publication Data

US 2012/0238126 A1 Sep. 20, 2012

(51) Int. Cl.
*H01R 4/26* (2006.01)

(52) U.S. Cl.
USPC ..... 439/395; 439/941

(58) Field of Classification Search
USPC ..... 439/395–408, 607.05, 607.12, 660, 439/941
See application file for complete search history.

(56) References Cited

U.S. PATENT DOCUMENTS

| | | | |
|---|---|---|---|
| 5,766,040 | A | 6/1998 | Naerland et al. |
| 6,077,122 | A | 6/2000 | Elkhalib et al. |
| 6,116,965 | A | 9/2000 | Arnett et al. |
| 6,287,149 | B1 | 9/2001 | Elkhatib et al. |
| 6,475,009 | B2 | 11/2002 | Below et al. |
| 6,595,791 | B2 | 7/2003 | Below et al. |
| 7,074,066 | B2 | 7/2006 | Pepe |
| 7,195,518 | B2 | 3/2007 | Bert et al. |
| 7,207,807 | B2 | 4/2007 | Fogg |
| 7,234,877 | B2 | 6/2007 | Sedor |
| 7,275,961 | B2 | 10/2007 | Zauber et al. |
| 7,303,418 | B2 | 12/2007 | O'Connor |
| 7,316,584 | B2 | 1/2008 | Mackillop et al. |
| 7,393,144 | B2 | 7/2008 | Khemakhem et al. |
| 7,404,739 | B2 | 7/2008 | Sheilds et al. |
| 7,422,484 | B2 | 9/2008 | Cohen et al. |
| 2006/0246780 | A1 | 11/2006 | Bert et al. |

FOREIGN PATENT DOCUMENTS

| | | | |
|---|---|---|---|
| DE | 10 2006 010279 | A1 | 9/2007 |
| WO | 2004/105186 | A1 | 12/2004 |

OTHER PUBLICATIONS

International Search Report, International Application No. PCT/US2012/028474, International Filing Date, Sep. 3, 2012.
M8/M12 Connector Systems, M8/M12 Connector System Product Line Information, http://catalog.tycoeelctronics.com, 2 pgs.

*Primary Examiner* — Khiem Nguyen

(57) ABSTRACT

A contact assembly includes a contact organizer having a central axis. A plurality contacts are secured to the contact organizer. The contacts are arranged as differential pairs. The contacts have mating segments and termination segments extending from the mating segments. The mating segments extend along the central axis. The termination segments are configured to terminate to corresponding wires. The mating segments of each differential pair of contacts are radially offset from the central axis of the contact organizer. Wire holders are coupled to the contact organizer. The wire holders have openings extending therethrough and are configured to receive wires. The wire holders are configured to terminate the wires to the termination segments of the contacts when the wire holders are coupled to the contact organizer.

19 Claims, 8 Drawing Sheets

CONTACT ASSEMBLY FOR ELECTRICAL CONNECTOR

BACKGROUND OF THE INVENTION

The subject matter described herein relates to an electrical connector, and more particularly, to a contact assembly for an electrical connector.

Electrical connectors used to plug a communication cable into an electrical system may include a housing that contains several conductors that form differential pairs. The differential pairs are configured to connect with corresponding differential pairs in a mating connector of the electrical system (e.g., a port) when the electrical and mating connectors are engaged. However, electrical connectors that are currently used may have certain limitations due to unwanted electromagnetic coupling between the differential pairs. For example, the operating speeds of M-series electrical connectors are limited to transmission rates of less than one gigabit per second. If current M-series electrical connectors were to operate at speeds above one gigabit/s, the unwanted electromagnetic coupling between the differential pairs would harm signal integrity and the performance of the connector. For example, the increase in near-end crosstalk (NEXT), far-end crosstalk, and/or return loss may render the connector unable to meet industry requirements. Accordingly, some electrical connectors are configured to reduce the negative effects of electromagnetic coupling. In particular, the contacts of each differential pair are offset so that each contact pair is not equidistant from the contacts of an adjacent differential pair.

However, known electrical connectors are not without their disadvantages. In particular, the offset contacts may create difficulty when coupling wires thereto. Often, a tool is required to join wires to the termination end of each contact. Additionally, known electrical connectors with offset contacts typically do not utilize insulation displacement contacts (IDCs). Generally, a differential pair of wires joined to IDCs must remain parallel to reduce crosstalk between the wires. However, the offset IDCs require that the wires be joined thereto in an offset configuration.

A need remains for an electrical connector that provides offset differential pairs, while enabling the use IDCs.

SUMMARY OF THE INVENTION

In one embodiment, a contact assembly is provided. The assembly includes a contact organizer having a central axis. A plurality contacts are secured to the contact organizer. The contacts are arranged as differential pairs. The contacts have mating segments and termination segments extending from the mating segments. The mating segments extend along the central axis. The termination segments are configured to terminate to corresponding wires. The mating segments of each differential pair of contacts are radially offset from the central axis of the contact organizer. Wire holders are coupled to the contact organizer. The wire holders have openings extending therethrough and are configured to receive wires. The wire holders are configured to terminate the wires to the termination segments of the contacts when the wire holders are coupled to the contact organizer.

In another embodiment, a pluggable connector is provided. The connector includes a housing having a mating end and a cable end. The housing has an inner cavity. A contact assembly is received in the inner cavity. The contact assembly includes a contact organizer having a central axis. A plurality of contacts are secured to the contact organizer. The contacts are arranged as differential pairs. The contacts have mating segments and termination segments extending from the mating segments. The mating segments extend along the central axis. The termination segments are configured to terminate to corresponding wires. The mating segments of each differential pair of contacts are radially offset from the central axis of the contact organizer. Wire holders are coupled to the contact organizer. The wire holders have openings extending therethrough and are configured to receive wires. The wire holders are configured to terminate the wires to the termination segments of the contacts when the wire holders are coupled to the contact organizer.

In another embodiment, a contact assembly is provided including a contact organizer having a central axis. The contact organizer is divided into quadrants, wherein each quadrant has a cavity formed therein. A plurality of contacts are secured to the contact organizer and arranged as differential pairs. Each differential pair is secured in a different quadrant of the contact organizer. The contacts within the differential pair are radially offset from the central axis of the contact organizer to define an inner contact and an outer contact. Wire holders are inserted into the cavities of the contact organizer. The wire holders have openings extending therethrough that are configured to receive wires. The wire holders are configured to terminate the wires to the contacts when the wire holders are coupled to the contact organizer.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Embodiments described herein include pluggable connectors having contacts that form differential pairs. The differential pairs may be arranged to improve the performance of the pluggable connectors with respect to other known connectors. For example, embodiments described herein have differential pairs arranged to reduce, control, or improve upon at least one of insertion loss, near-end crosstalk (NEXT), far-end crosstalk, and return loss. A "pluggable connector," as described herein, is an electrical connector that is configured to mate with another electrical connector (also referred to as a mating connector) through a pluggable engagement. For example, pluggable connectors described herein include plug connectors that have a plug insert configured to be inserted into a cavity of a mating connector. The pluggable connectors may also be receptacle connectors having a cavity that receives a plug insert from a mating connector. Accordingly, a connector assembly of two pluggable connectors may include a first pluggable connector having a plug insert that is inserted into a cavity of a second pluggable connector that has a cavity configured to receive the plug insert.

The pluggable connectors may be electrical connectors. When the pluggable connectors are engaged, the pluggable connectors may establish an environmental seal that protects transmissions through the connectors. Also, the pluggable connectors may establish at least one of a communicative and power connection. The communicative connection may be an electrical connection. In addition, the pluggable connectors may operate at high-speeds, such as at least one gigabit per second. In other embodiments, the pluggable connectors may transmit at multiple gigabits/s, such as at least ten (10) gigabits/s.

Figure 1:
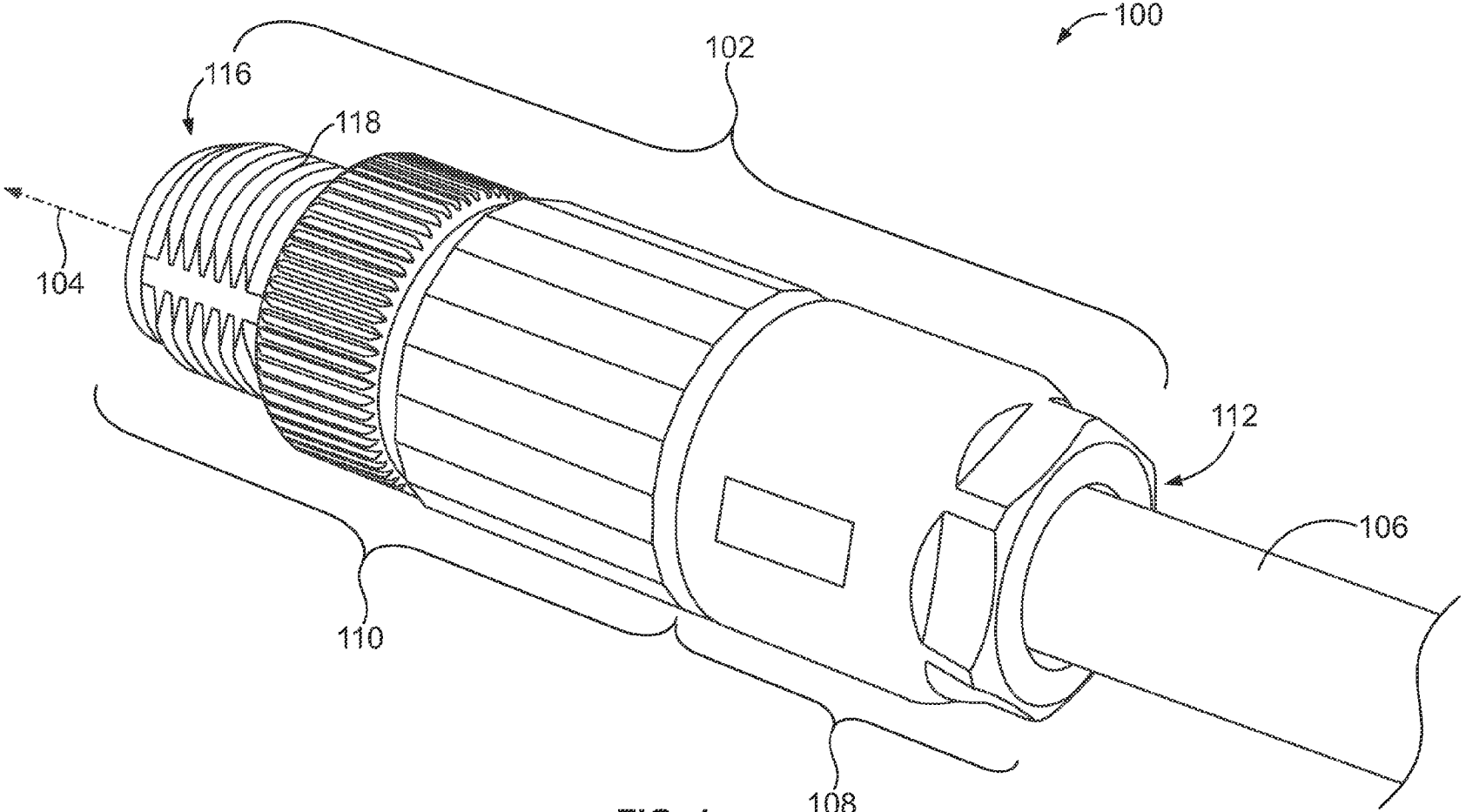
FIG. 1 is a perspective view of a pluggable connector formed in accordance with an embodiment.

FIG. 1 is a perspective view of a pluggable connector 100 formed in accordance with an embodiment. The pluggable connector 100 may include a housing 102 that extends along a central axis 104 and is connected to a cable 106. The pluggable connector 100 may have a linear structure such that the entire housing 102 extends along the central axis 104. Alternatively, the entire housing 102 might not extend along the central axis 104, but may be shaped as desired. For example, the housing 102 may have a right-angle structure.

The housing 102 includes a loading shell 108 and a mating shell 110. The loading shell 108 and the mating shell 110 are coupled to form the housing 102. As illustrated, the loading shell 108 and the mating shell 110 extend along the central axis 104. The loading shell 108 includes a cable end 112 to receive the cable 106. Wires 114 (shown in FIG. 2) of the cable 106 are joined to contacts 120 (shown in FIG. 2) within the housing 102. The contacts 120 are generally provided at a mating end 116 of the mating shell 110 to engage a mating connector (not shown).

The mating end 116 of the mating shell 110 may have a cross-section taken perpendicular to the central axis 104 that is sized and shaped to engage the mating connector. In an exemplary embodiment, the cross-section of the mating end 116 may be substantially circular. Furthermore, the mating end 116 of the mating shell 110 may be sized and shaped to receive a plug insert from the mating connector. As shown, the mating end 116 has an outer surface 118 that may be configured to fasten to the mating connector. For example, the outer surface 118 may be threaded and configured to engage complementary threads on an inner surface of the mating connector.

Figure 2:
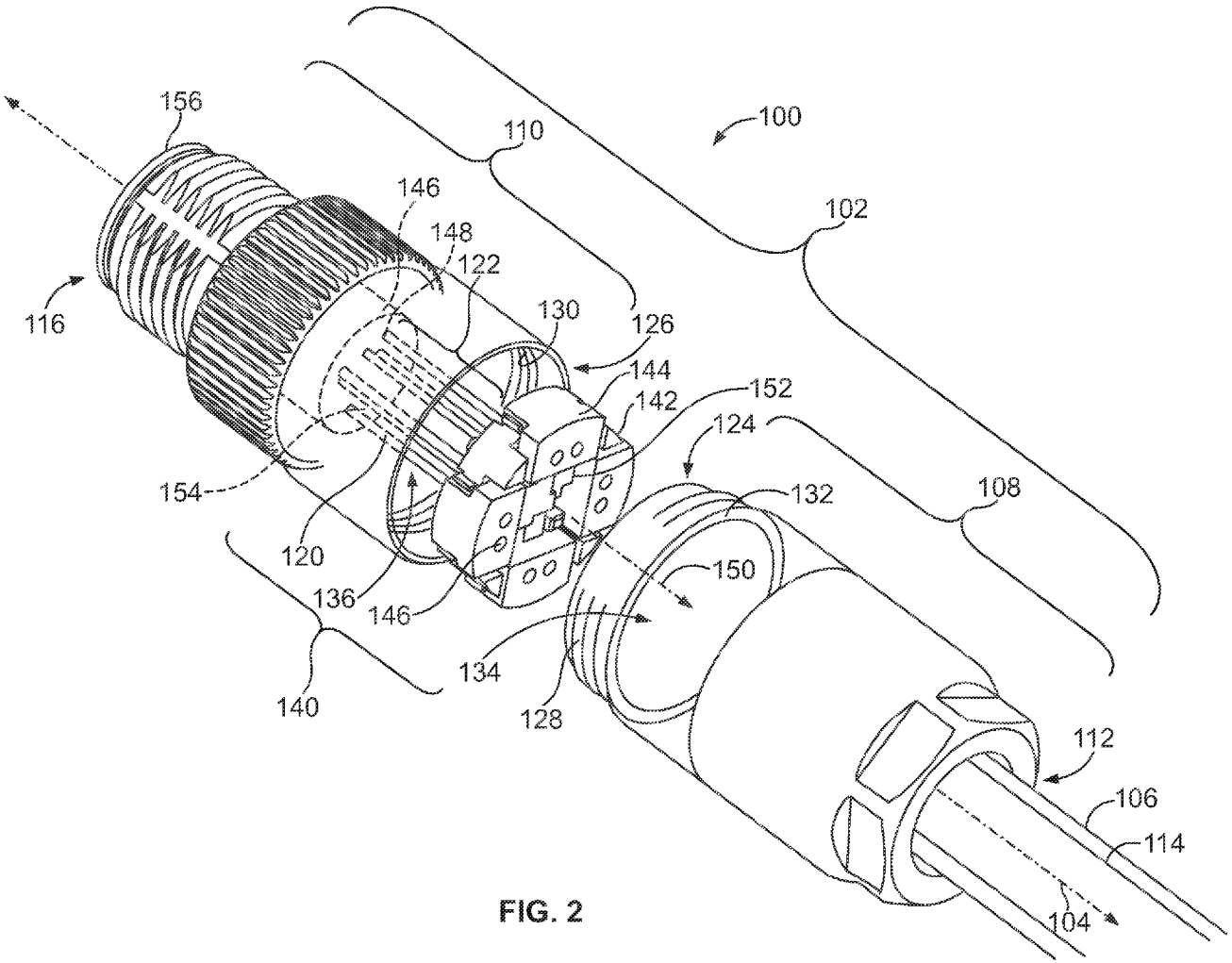
FIG. 2 is an exploded view of the pluggable connector shown in FIG. 1.

FIG. 2 is an exploded view of the pluggable connector 100. The loading shell 108 and the mating shell 110 include coupling ends 124 and 126, respectively. The coupling end 124 of the loading shell 108 is positioned on an opposite end of the loading shell 108 from the cable end 112. The coupling end 126 of the mating shell 110 is positioned on an opposite end of the mating shell 110 from the mating end 116. The coupling ends 124 and 126 are configured to be coupled to one another to form the housing 102. In the illustrated embodiment, the coupling end 124 of the loading shell 108 includes a threaded outer surface 128 that is configured to engage complementary threads on an inner surface 130 of the coupling end 126 of the mating shell 110. Alternatively, the coupling end 124 of the loading shell 108 may include a threaded inner surface that is configured to engage complementary threads on an outer surface of the coupling end 126 of the mating shell 110. A seal 132 is positioned around the coupling end 124 of the loading shell 108 to prevent leakage in the connector 100 when the loading shell 108 is joined to the mating shell 110 to form the housing 102. The seal 132 may be positioned on the coupling end 126 of the mating shell 110 in alternative embodiments.

The loading shell 108 and the mating shell 110 include cavities 134 and 136, respectively, formed therein. When the loading shell 108 is coupled to the mating shell 110 the cavities 134 and 136 form in inner cavity of the housing 102.

The cable end 112 of the loading shell 108 receives the cable 106. The wires 114 of the cable 106 extend into the cavity 134 of the loading shell 108. The wires are arranged in differential pairs with one wire 114 having a positive polarity and the other wire 114 having a negative polarity.

A contact assembly 140 is positioned within the inner cavity of the housing 102. The contact assembly 140 includes a central axis 150 that may extend along the central axis 104 of the housing 102. In one embodiment, the contact assembly 140 is configured to be positioned within the cavity 136 of the mating shell 110. The contact assembly 140 includes a contact organizer 142.

A contact array 122 of contacts 120 is held by the contact organizer 142. Each contact 120 includes a termination segment 152 and a mating segment 154. The mating segment 154 of each contact 120 extends axially from the contact organizer 142 parallel to the central axis 150 of the contact organizer 142. The termination segment 152 of each contact 120 extends radially outward from the central axis 150 of the contact organizer 142. The contacts 120 are arranged in differential pairs that are each radially offset from the central axis 150 of the contact organizer to define an inner contact 190 (shown in FIG. 4) and an outer contact 160 (shown in FIG. 3).

Wire holders 144 are coupled to the contact organizer 142. The wire holders 144 include openings 146 extending therethrough to receive the wires 114 of the cable 106. The wire holders 144 are coupled to the contact organizer 142. During assembly, when the wire holders 144 are coupled to the contact organizers 142 the wires 114 are terminated to the termination segments 152 of corresponding contacts 120, such as by an insulation displacement connection.

A dielectric housing 146 is positioned at the mating end 116 of the mating shell 110. The dielectric housing 146 extends from the mating end 116 into the cavity 136 of the mating shell 110. The dielectric housing 146 includes contact channels 148 extending therethrough. The contact channels 148 receive the mating segments 154 of corresponding contacts 120. The contact channels 148 extend through the dielectric housing 146 to a mating face 156 of the dielectric housing 146. The mating face 156 of the dielectric housing 146 couples to a corresponding mating face of the mating connector such that the contacts 120 engage corresponding contacts of the mating connector when the connector 100 is joined to the mating connector. The dielectric housing 146 electrically isolates the contacts 120 from the mating shell 110. The mating shell 110 is conductive and provides shielding around the contact array 122.

Figure 3:
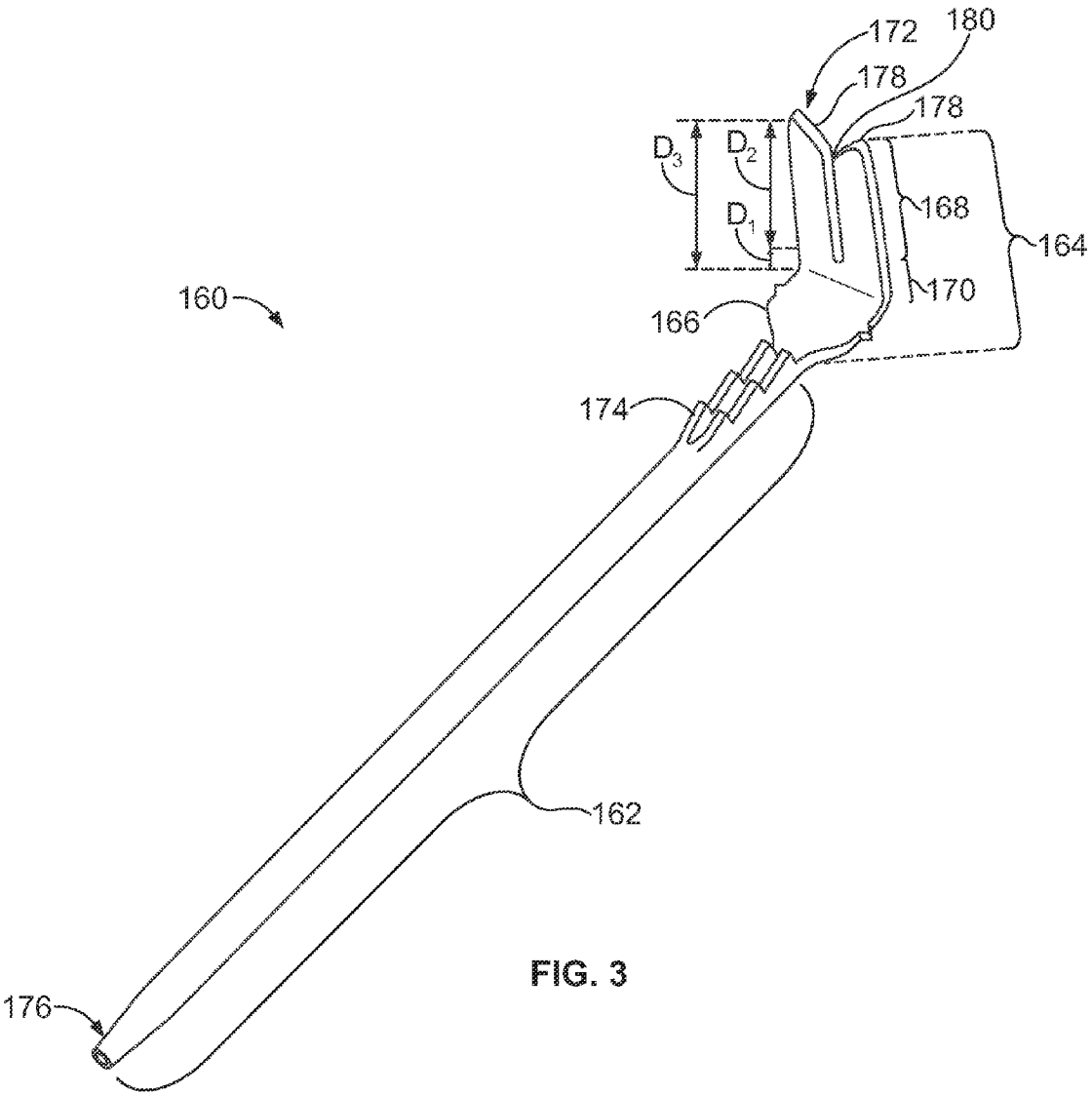
FIG. 3 is a perspective view of an outer contact formed in accordance with an embodiment.

FIG. 3 is a perspective view of an outer contact 160 formed in accordance with an embodiment. The outer contact 160 may be used in the place of one of the contacts 120 (shown in FIG. 2). The outer contact 160 includes a mating segment 162 and a termination segment 164. The outer contact 160 may be stamped and formed. The mating segment 162 may be rolled into a cylindrical configuration, as illustrated in FIG. 3. In the illustrated embodiment, the outer contact 160 is formed as an insulation displacement contact (IDC).

The termination segment 164 includes a base 166 and an insulation displacement portion 168. An intermediate portion 170 extends between the base 166 and the insulation displacement portion 168. The intermediate portion 170 extends substantially perpendicular from the base 166. The insulation displacement portion 168 extends from the intermediate portion 170 substantially perpendicular to the base 166. A termination end 172 is formed at an end of the insulation displacement portion 168. The intermediate portion 170 extends a distance $D_1$ between the base 166 and the insulation displacement portion 168. The insulation displacement portion 168 extends a distance $D_2$ between the intermediate portion 170 and the termination end 172. The insulation displacement portion 168 and the intermediate portion 170 extend a combined distance $D_3$.

The insulation displacement portion 168 includes a pair of blades 178 with a slot 180 formed therebetween. The slot 180 extends from the termination end 172 to the intermediate portion 170 of the termination segment 164. The slot 180 is configured to receive a wire, for example, a wire 114 as illustrated in FIG. 2. The blades 178 slice into a jacket of the wire 114 such that the termination segment 164 contacts an inner conductor (not shown) of the wire 114. In the illustrated embodiment, the blades 178 have tapered ends to guide the wire 114 into the slot 180.

The mating segment 162 includes a retention surface 174 formed proximate to the termination segment 164. The retention surface 174 may be a serrated surface, a notched surface, or the like. The retention surface 174 forms an interference fit with a contact channel 148 of the dielectric housing 146 (both shown in FIG. 2) when the contact assembly 140 is joined to the dielectric housing 146. The mating segment 162 includes a mating end 176. The mating end 176 may be tapered and configured to be inserted into an opening of a corresponding contact of a mating connector. Alternatively, the mating end 176 may include an opening to receive a corresponding contact of a mating connector.

Figure 4:
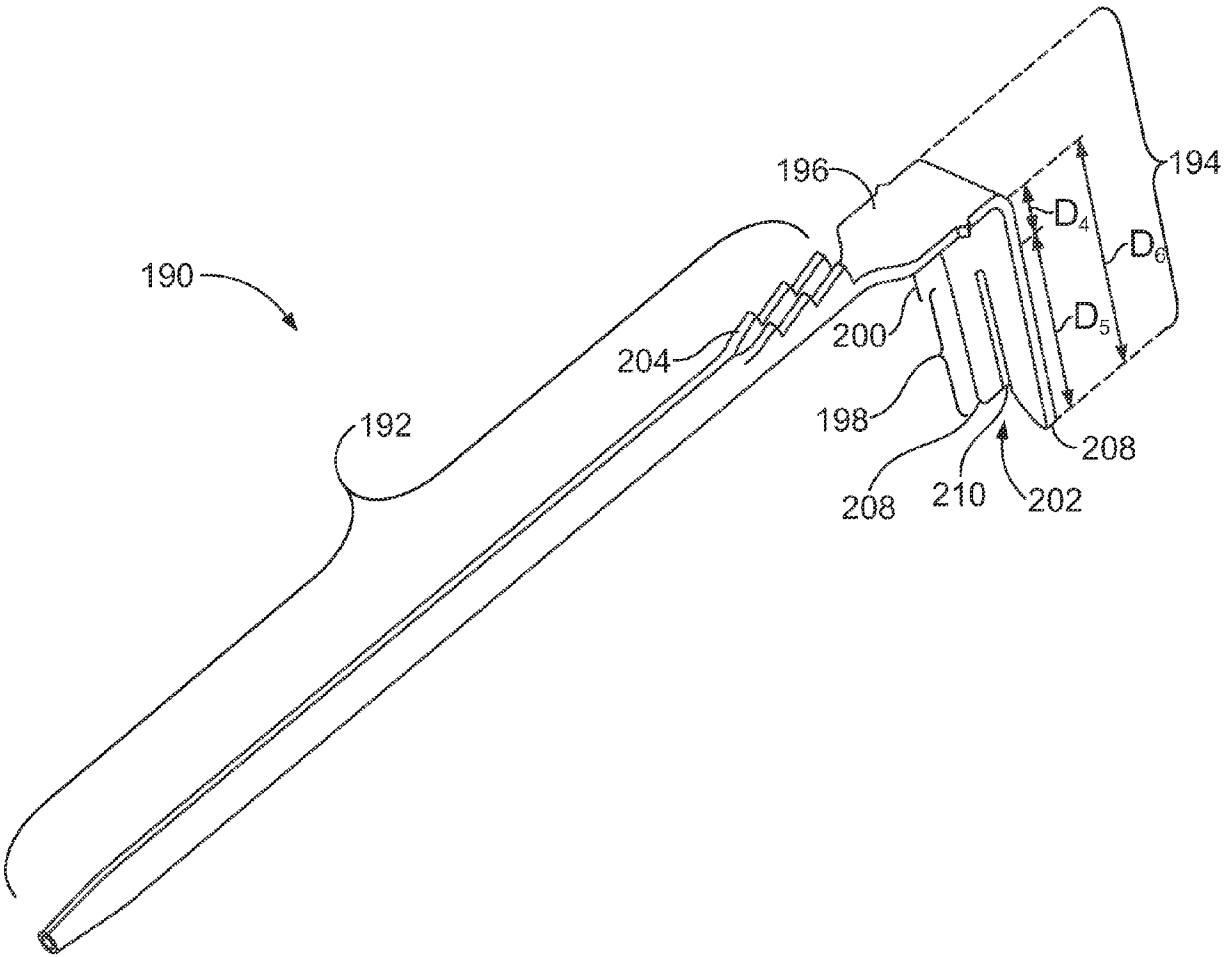
FIG. 4 is a perspective view of an inner contact formed in accordance with an embodiment.

FIG. 4 is a perspective view of an inner contact 190 formed in accordance with an embodiment. The inner contact 190 may be used in the place of one of the contacts 120 (shown in FIG. 2). The inner contact 190 includes a mating segment 192 and a termination segment 194. The inner contact 190 may be stamped and formed. The mating segment 192 may be rolled into a cylindrical configuration, as illustrated in FIG. 4. In the illustrated embodiment, the inner contact 190 is formed as an insulation displacement contact.

The termination segment 194 includes a base 196 and an insulation displacement portion 198. An intermediate portion 200 extends between the base 196 and the insulation displacement portion 198. The intermediate portion 200 extends substantially perpendicular from the base 196. The insulation displacement portion 198 extends from the intermediate portion 200 substantially perpendicular to the base 196. A termination end 202 is formed at an end of the insulation displacement portion 198. The intermediate portion 200 extends a distance $D_4$ between the base 196 and the insulation displacement portion 198. The distance $D_4$ may be the same as the distance $D_1$ between the base 166 and the insulation displacement portion 168 of the outer contact 160. The insulation displacement portion 198 extends a distance $D_5$ between the intermediate portion 200 and the termination end 202. The distance $D_5$ is greater than the distance $D_2$ between the intermediate portion 170 and the termination end 172 of the outer contact 160. The insulation displacement portion 198 and the intermediate portion 200 extend a combined distance $D_6$. The distance $D_6$ is greater than the combined distance $D_3$ of the insulation displacement portion 168 and the intermediate portion 170 of the outer contact 160.

The insulation displacement portion 198 includes a pair of blades 208 with a slot 210 formed therebetween. The slot 210 extends from the termination end 202 to the intermediate portion 200 of the termination segment 194. The slot 210 is configured to receive a wire, for example, a wire 114 as illustrated in FIG. 2. The blades 208 slice into a jacket of the wire 114 such that the termination segment 194 contacts an inner conductor (not shown) of the wire 114. In the illustrated embodiment, the blades 208 have tapered ends to guide the wire 114 into the slot 210.

The mating segment 192 includes a retention surface 204 formed proximate to the termination segment 194. The retention surface 204 may be a serrated surface, a notched surface, or the like. The retention surface 204 forms an interference fit with a contact channel 148 of the dielectric housing 146 when the contact assembly 140 is joined to the dielectric housing 146. The mating segment 192 includes a mating end 197. The mating end 197 may be tapered and configured to be inserted into an opening of a corresponding contact of a mating connector. Alternatively, the mating end 197 may include an opening to receive a corresponding contact of a mating connector.

Figure 5:
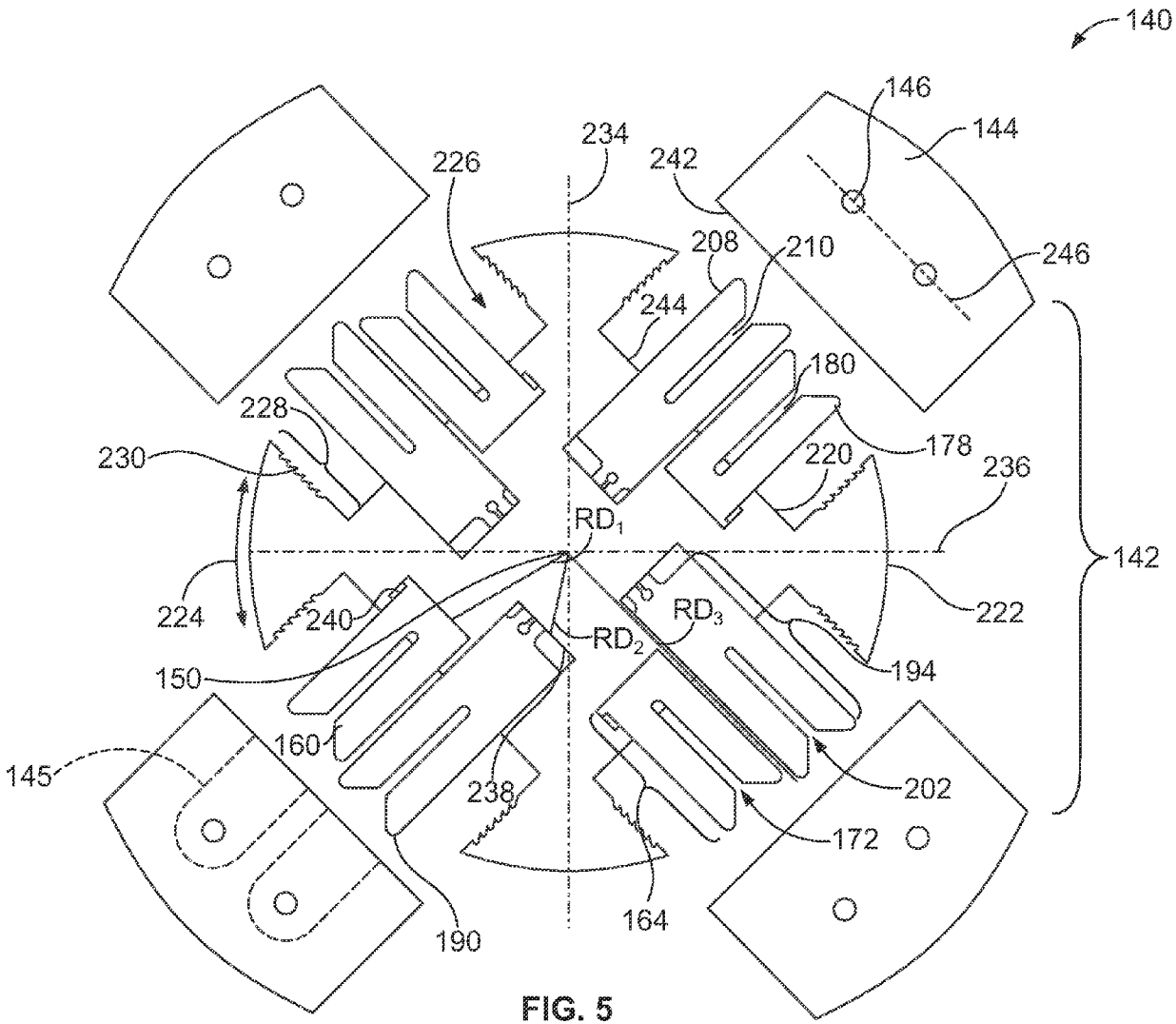
FIG. 5 is a cable end view of a contact assembly formed in accordance with an embodiment.

FIG. 5 is a cable end view of the contact assembly 140. In the illustrated embodiment, the contact organizer 142 includes a hub 220 and extensions 222 extending radially outward from the hub 220. The contact organizer 142 may have a generally circular shape with a perimeter 224 extending around each extension 222. Alternatively, the contact organizer 142 may have any suitable shape, such as rectangular. Cavities 226 are formed in the contact organizer 142 between adjacent extensions 222. The cavities 226 define outer surfaces 228 of the extensions 222. Retention surfaces 230 are formed on the outer surfaces 228 of each extension 222. The retention surfaces 230 may be serrated surfaces, notched surfaces, or the like.

The central axis 150 of the contact assembly 140 extends through the hub 220. The contact organizer 142 may be divided into quadrants 232 by lines 234 and 236 extending perpendicular to and through the central axis 150. The lines 234 and 236 extend perpendicular to one another and cross at the central axis 150. Each cavity 226 is positioned within one of the quadrants 232. Each extension 222 is generally bifurcated by one of the lines 234 or 236 and extends into each of adjacent quadrants 232. Optionally, each extension 222 may be bifurcated unequally.

Each quadrant 232 includes an inner slot 238 and an outer slot 240 extending through the contact organizer 142. The outer slot 240 and the inner slot 238 are angularly offset with respect to the central axis 150. The outer slot 240 and the inner slot 238 are radially offset with respect to the central axis 150. The outer slot 240 is positioned a radial distance $RD_1$ from the central axis 150. The inner slot 238 is positioned a radial distance $RD_2$ from the central axis 150. The radial distance $RD_1$ is greater than the radial distance $RD_2$. The outer slot 240 is configured to receive an outer contact 160 therethrough. The inner slot 238 is configured to receive an inner contact 190 therethrough.

Each quadrant 232 includes a differential pair of contacts 120. Each quadrant 232 includes an outer contact 160 and an inner contact 190. The termination segments 164 and 194 of the outer contact 160 and the inner contact 190, respectively, extend into the cavity 226 of each quadrant 232. The termination ends 172 and 202 are positioned a radial distance $RD_3$ from the central axis 150. The termination ends 172 and 202 of the outer contact 160 and the inner contact 190, respectively, are aligned along the perimeter 224 of the contact organizer 142.

The wire holders 144 are configured to be received in the cavities 226. The retention surfaces 230 formed on the outer surfaces 228 of the extensions 222 retain the wire holders 144 within the cavity 226. The wire holders 144 are received within the cavities 226 such that a hub surface 242 of the wire holder 144 abuts a hub surface 244 of the contact organizer 142.

The wires 114 (shown in FIG. 2) are received in the openings 146 of the wire holders 144. The openings 146 are aligned along a line 246. The line 246 extends parallel to the hub surface 242 of the wire holder 144. Aligning the wires 114 along the line 246 reduces cross-talk between the wires 114. When the wire holders 144 are received within the cavities 226 the outer contact 160 and the inner contact 190 are received in channels 145 extending into the wire holder 144 such that the wires 114 engage one of the outer contact 160 and the inner contact 190. The wires 114 are received in the slots 180 and 210 of the outer contact 160 and the inner contact 190, respectively. The blades 178 and 208 of the outer contact 160 and the inner contact 190, respectively, remove the jacket of the wires 114 so that the blades 178 and 208 engage an inner conductor of the wire 114.

Figure 6:
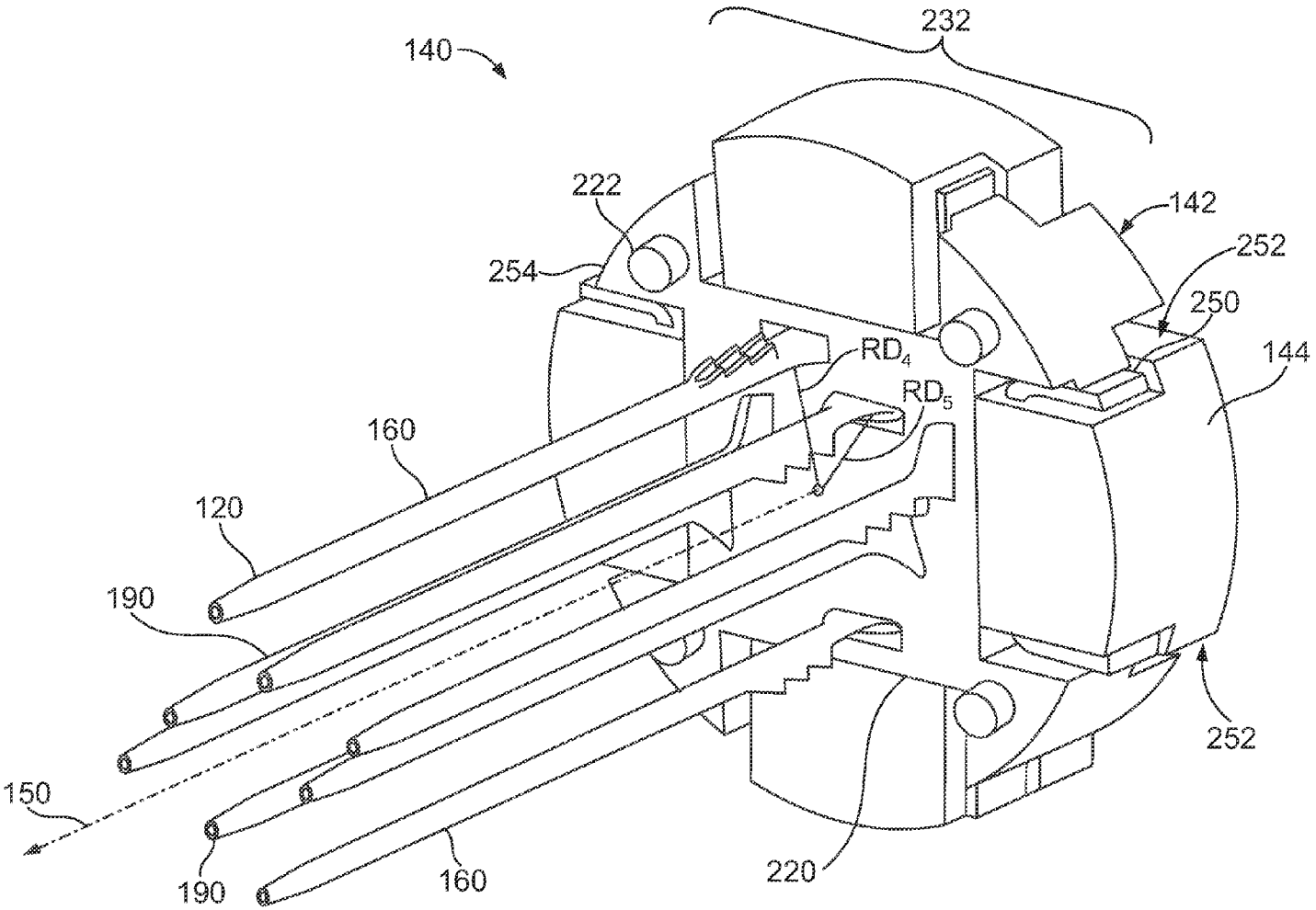
FIG. 6 is perspective view of a mating end of the contact assembly shown in FIG. 5.

FIG. 6 is perspective view of a mating end of the contact assembly 140. The contacts 120 are radially offset with respect to the central axis 150 of the contact organizer 142. Each contact 120 is arranged at a different angular position with respect to the central axis 150. Each quadrant 232 includes an outer contact 160 and an inner contact 190. The outer contact 160 and the inner contact 190 are radially offset from one another with respect to the central axis 150. The outer contact 160 is positioned a radial distance $RD_4$ from the central axis 150. The inner contact 190 is positioned a radial distance $RD_5$ from the central axis 150. The radial distance $RD_4$ is greater than the radial distance $RD_5$. The inner contact 190 and the outer contact 160 of each differential pair of contacts 120 are radially offset to reduce cross-talk between differential pairs of contacts 120. The configuration of the contacts 120 is described in greater detail with respect to FIG. 8.

As illustrated in FIG. 6, each wire holder 144 includes a flange 250 formed on the opposite sides 252 of the wire holder 144. The flanges 250 may be flexible and capable of moving when the wire holder 144 is coupled to the contact organizer 142. The flanges 250 form an interference fit with the retention surfaces 230 (shown in FIG. 5) formed on the extensions 222 of the contact organizer 142. The flanges 250 and the retention surfaces 230 retain the wire holder within the cavities 226 (shown in FIG. 5) of the contact organizer 142. In an exemplary embodiment, the flanges 250 may be compressed to remove the wire holders 144 from the cavities 226.

In the illustrated embodiment, each extension 222 includes an alignment post 254 extending therefrom. The alignment posts 254 may extend from the hub 220 in alternative embodiments. The alignment posts 254 are configured to be received in apertures (not shown) formed in the dielectric housing 146 (shown in FIG. 2). The alignment posts 254 align the contact organizer 142 with respect to the dielectric housing 146. In one embodiment, the alignment posts 254 may create an interference fit with the dielectric housing 146 to retain the contact organizer 142 within the dielectric housing 146. In alternative embodiments, the dielectric housing 146 may include alignment posts that are configured to be received within apertures formed in the contact organizer 142.

Figure 7:
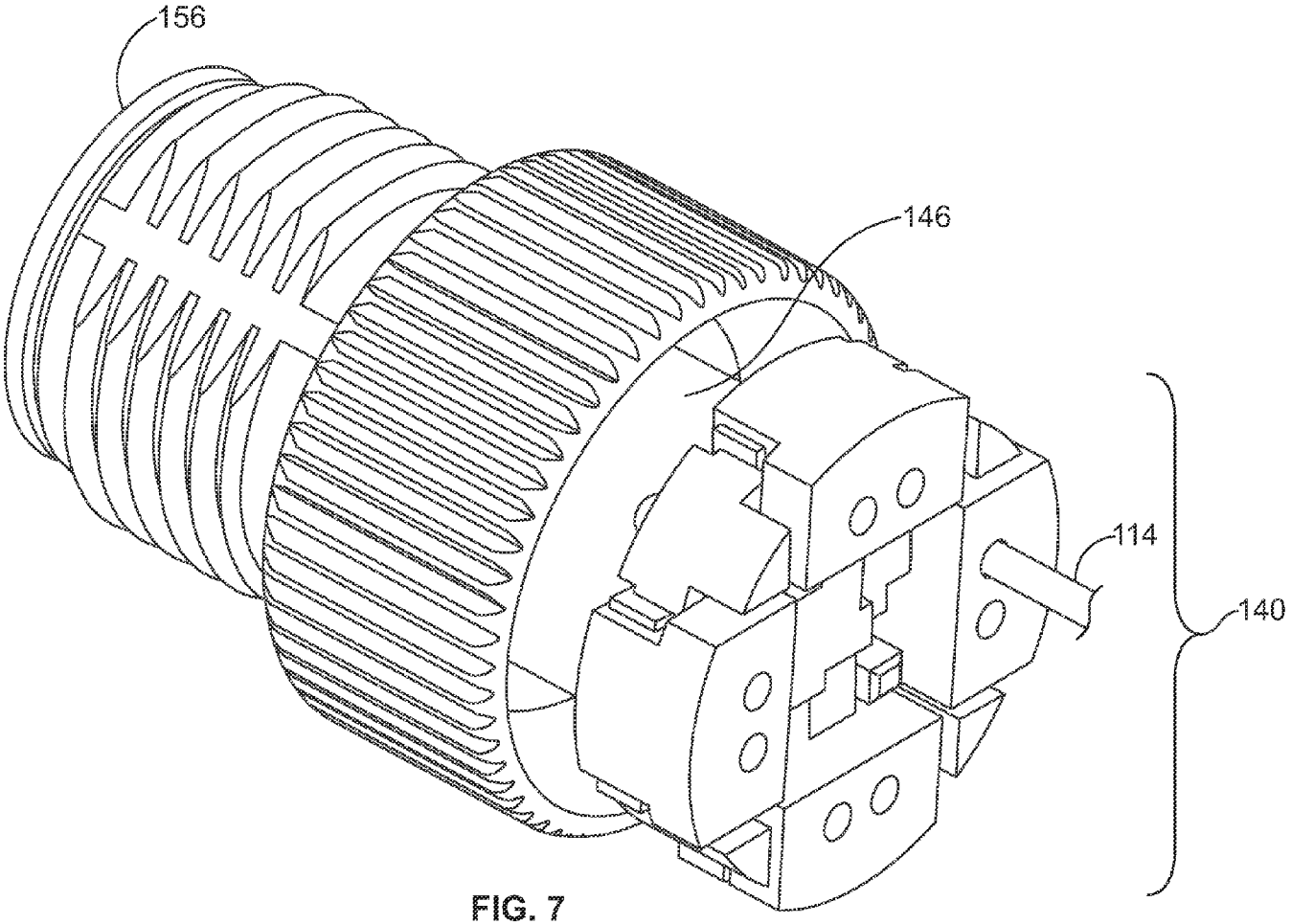
FIG. 7 is a perspective view of the contact assembly inserted into the dielectric housing shown in FIG. 2.

FIG. 7 is a perspective view of the contact assembly 140 inserted into the dielectric housing 146. The contact assembly 140 abuts the dielectric housing 146 such that the contact assembly 140 is positioned within the cavity 136 of the mating shell 110 (both shown in FIG. 2). The contacts 120 (shown in FIG. 2) are inserted into the contact channels 148 (shown in FIG. 2) of the dielectric housing 146 such that the contacts 120 extend from the mating face 156 of the dielectric housing 146. The wires 114 extend from the contact assembly 140 into the cavity 134 of the loading shell 108 (both shown in FIG. 2).

Figure 8:
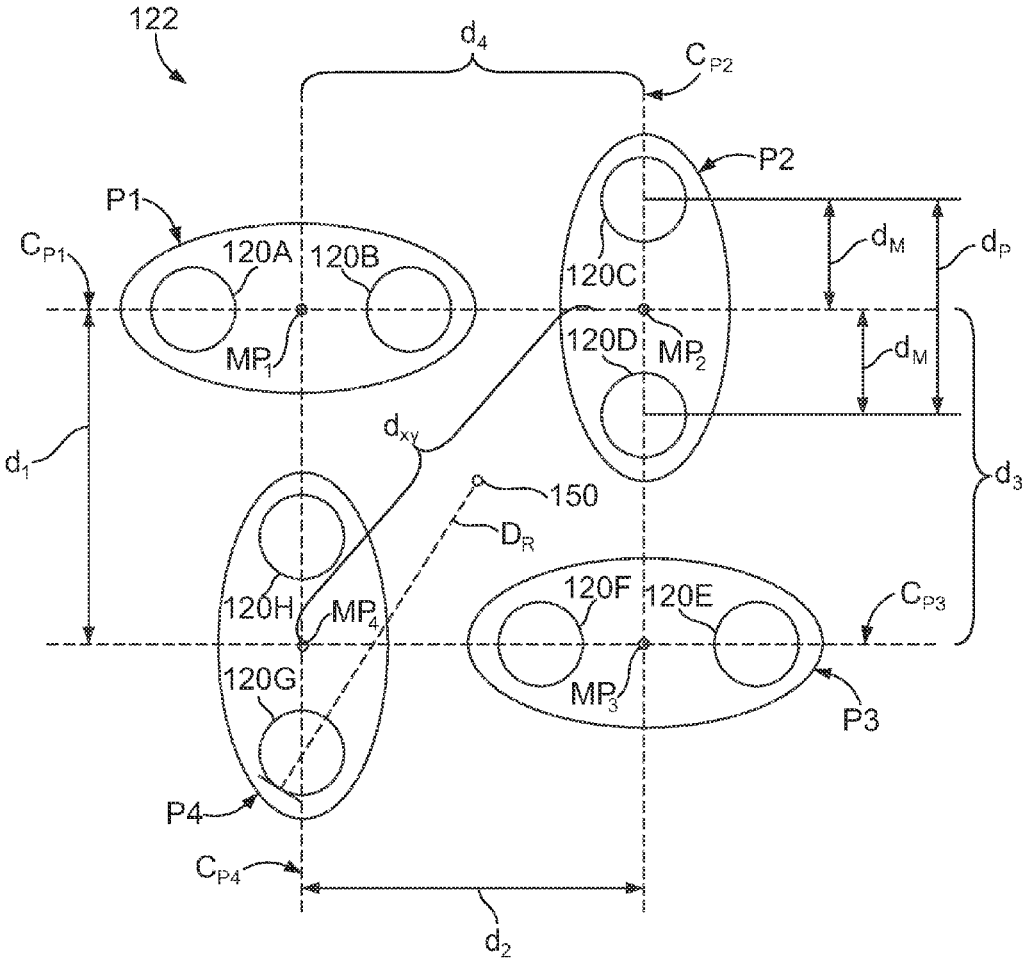
FIG. 8 is a schematic view of an array of contacts formed in accordance with an embodiment.

FIG. 8 illustrates the array 122 of contacts 120 for the pluggable connector 100 (shown in FIG. 1). The contacts 120 extend parallel to one another and to the central axis 150. Two contacts 120 may form a differential pair P and, in the illustrated embodiment, only four differential pairs P are formed. More specifically, the contacts 120A and 120B form the differential pair P1; the contacts 120C and 120D form the differential pair P2; the contacts 120E and 120F form the differential pair P3; and the contacts 120G and 120H form the differential pair P4. Although not specifically shown, each differential pair P has one contact having a positive polarity and another contact having a negative polarity.

The contacts 120 that form a corresponding differential pair P may be adjacent to one another. As used herein, two contacts are "adjacent" to one another when the two contacts do not have any other contact located directly between the two and the two contacts are relatively close to one another as compared to other contacts. For example, the contact 120A is relatively close to the contact 120B and 120H, and the contact 120D is relatively close to the contacts 120C, 120B, 120F, and 120E. In some embodiments, the adjacent contacts 120 that make a differential pair P are not closer to any other contact 120.

The differential pairs P1-P4 are arranged with respect to each other in order to minimize unwanted electromagnetic coupling between the differential pairs P1-P4. As shown, the two contacts 120 of each differential pair P are separated from each other by a distance $d_P$. Furthermore, the two contacts 120 of each differential pair P have a midpoint MP therebetween. At the corresponding midpoint MP, each contact 120 of the differential pair P is a distance $d_M$ away from the MP of the differential pair. The distances $d_M$ for each contact 120 is equal.

Also shown, the two contacts 120 of each differential pair P extend parallel to each other along a contact plane Cp of the differential pair P. More specifically, the differential pair P1 has the contact plane $C_{P1}$, the differential pair P2 has the contact plane $C_{P2}$, the differential pair P3 has the contact plane $C_{P3}$, and the differential pair P4 has the contact plane $C_{P4}$. In some embodiments, the contact planes $C_P$ of at least two differential pairs P are perpendicular to one another. In the illustrated embodiment, each of the four differential pairs P1-P4 have a corresponding contact plane $C_P$ that extends perpendicular to the contact planes $C_P$ of two other differential pairs. For example, the contact plane $C_{P3}$ of the differential pair P3 is perpendicular to the contact plane $C_{P2}$ and $C_{P4}$.

Also shown, the contact plane $C_P$ of a differential pair P may be positioned such that the contact plane $C_P$ bisects the distance $d_P$ separating the contacts 120 of an adjacent differential pair P (i.e., extends through the corresponding midpoint MP). For example, the contact plane $C_{P1}$ bisects the distance $d_P$ that separates the contacts 120C and 120D into two equal distances $d_m$ and $d_m$. In alternative embodiments, the contact plane $C_P$ may be positioned such that the contact plane $C_P$ intersects a contact 120 of an adjacent differential pair P or intersects the contact plane $C_P$ of the adjacent differential pair P at a location that is not between the contacts 120. Furthermore, the contact plane $C_P$ of one differential pair P may intersect the contact plane $C_P$ of an adjacent differential pair P at a point between the contacts 120 of the adjacent differential pair P, but not at the midpoint MP.

Furthermore, the array 122 may be configured to fit within a predetermined cross-sectional area. For example, the array 122 of contacts 120 may be located with respect to each other so that the contacts 120 are located within a predetermined radial distance $D_R$ from the central axis 150. The radial distance $D_R$ may be, for example, less than about 13 mm or less than about 6 mm.

Moreover, the midpoints MP of each contact plane $C_P$ may be separated from each other by a distance configured to fit within a limited cross-sectional area while maintaining a desired performance. For example, the midpoint $MP_1$ and $MP_4$ may be separated from each other by a distance $d_1$; the midpoints MP4 and MP3 may be separated from each other by a distance $d_2$; the midpoints MP3 and MP2 may be separated from each other by a distance $d_3$; and the midpoints MP2 and MP1 may be separated from each other by a distance $d_4$.

In a particular embodiment, the distances $d_1$-$d_4$ are substantially equal and the distance $d_{XY}$ is no greater than 1.75 times one of the distances $d_1$-$d_4$. However, in other embodiments, the distances $d_1$-$d_4$ might not be substantially equal. For example, at least two of the distances $d_1$-$d_4$ may differ from each other by at least 10%. More specifically, the distances $d_1$ and $d_3$ may be equal, and the distances $d_2$ and $d_4$ may be equal. The distances $d_1$ and $d_3$ may be greater than the distances $d_2$ and $d_4$ by at least 10%. Alternatively, the distances $d_2$ and $d_4$ may be greater than the distances $d_1$ and $d_3$ by at least 10%. In such embodiments where at least two distances differ by at least 10%, the arrangement of differential pairs P may reduce the unwanted electromagnetic coupling between at least two differential pairs. Furthermore, such embodiments may improve at least one of NEXT, far-end crosstalk, insertion loss, and return loss.

In particular embodiments, the pluggable connectors described herein may be industrial type connectors that form an environmental seal and are able to withstand harsh weather and vibration or shaking while maintaining a desired transmission rate or performance. Furthermore, the pluggable connectors may obtain desired performance levels while having a limited cross-sectional area where the differential pairs or conductors are arranged with respect to each other. For example, the pluggable connectors may be industrial type M-series connectors where a cross-section of the plug insert or housing cavity is substantially circular. A diameter of a cross-section of the plug insert may be less than about 23 millimeters or, more specifically, less than about 12 millimeters. In alternative embodiments, the pluggable connector has a greater diameter and/or is not substantially circular.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A contact assembly comprising:

a contact organizer having a central axis;

a plurality of contacts secured to the contact organizer, the contacts being arranged as differential pairs, the contacts having mating segments and termination segments extending from the mating segments, the mating segments extending along the central axis, the termination segments extending generally radially outward from the central axis, the termination segments being configured to terminate to corresponding wires, the mating segments of each differential pair of contacts being radially offset from the central axis of the contact organizer, the termination segments of each differential pair of contacts having different lengths such that termination ends of each differential pair of contacts are at a same radial distance from the central axis of the contact organizer; and wire holders coupled to the contact organizer, the wire holders having openings extending therethrough and being configured to receive wires, the wire holders being configured to terminate the wires to the termination segments of the contacts when the wire holders are coupled to the contact organizer.

2. The assembly of claim 1, wherein the mating segments of the contacts within each differential pair of contacts are positioned at different radial distances from the central axis of the contact organizer.

3. The assembly of claim 1, wherein the termination segments of each differential pair of contacts include a base, an insulation displacement portion, and an intermediate portion extending between the base and the insulation displacement portion, the intermediate portions of each differential pair of contacts having different lengths.

4. The assembly of claim 1, wherein the termination segments of each differential pair of contacts include a base, an insulation displacement portion, and an intermediate portion extending between the base and the insulation displacement portion, the insulation displacement portions of each differential pair of contacts having the same length.

5. The assembly of claim 1, wherein the contact organizer is circular, each contact being arranged at a different angular position about the central axis of the contact organizer.

6. The assembly of claim 1, wherein the contact organizer is divided into quadrants, each differential pair of contacts positioned within a different quadrant.

7. The assembly of claim 1, wherein the contacts are configured as insulation displacement contacts.

8. The assembly of claim 1, wherein the contact organizer includes a hub and extensions extending from the hub, cavities being formed between adjacent extensions, the wire holders coupled to the contact organizer within the cavities.

9. A pluggable connector comprising:

a housing having a mating end and a cable end, the housing having an inner cavity; and a contact assembly received in the inner cavity, the contact assembly comprising:

a contact organizer having a central axis, a plurality contacts secured to the contact organizer, the contacts being arranged as differential pairs, the contacts having mating segments and termination segments extending from the mating segments, the mating segments extending parallel to the central axis, the termination segments being configured to terminate to corresponding wires, the mating segments of each differential pair of contacts being radially offset from the central axis of the contact organizer, the mating segments being arranged in the inner cavity such that the mating segments of the contacts of each differential pair are oriented along a plane, the planes of adjacent differential pairs being perpendicular to each other, and wire holders coupled to the contact organizer, the wire holders having openings extending therethrough and being configured to receive wires, the wire holders being configured to terminate the wires to the termination segments of the contacts when the wire holders are coupled to the contact organizer.

10. The connector of claim 9, wherein the mating segments of each differential pair of contacts are positioned at different radial distances from the central axis of the contact organizer.

11. The connector of claim 9, wherein the termination segments of each differential pair of contacts have different lengths such that termination ends of each differential pair of contacts are at a same radial distance from the central axis of the contact organizer.

12. The connector of claim 9, wherein the termination segments of each differential pair of contacts include a base, an insulation displacement portion, and an intermediate portion extending between the base and the insulation displacement portion, the intermediate portions of each differential pair of contacts having different lengths.

13. The connector of claim 9, wherein the termination segments of each differential pair of contacts include a base, an insulation displacement portion, and an intermediate portion extending between the base and the insulation displacement portion, the insulation displacement portions of each differential pair of contacts having the same length.

14. The connector of claim 9, wherein the housing is conductive and provides shielding for the contacts.

15. The connector of claim 9, further comprising a dielectric housing received in the inner cavity forward of the contact organizer, the dielectric housing having contact channels receiving corresponding contacts.

16. The connector of claim 9, wherein the housing has a circular cross-section.

17. A contact assembly comprising:

a contact organizer having a central axis, the contact organizer divided into quadrants, each quadrant having a cavity formed therein;

a plurality of contacts secured to the contact organizer, the contacts having termination segments, each termination segment having a slot flanked by opposing blades, the slot configured to receive corresponding wires, the contacts being arranged as differential pairs, each differential pair secured in a different quadrant of the contact organizer, the contacts within the differential pair being radially offset from the central axis of the contact organizer to define an inner contact and an outer contact, the slots of the termination segments of the contacts within each differential air being parallel to each other, the slots of the termination segments within each differential pair being perpendicular to the slots of the termination segments of each adjacent differential pair; and wire holders inserted into the cavities of the contact organizer, the wire holders having openings extending therethrough that are configured to receive the wires, the wire holders being configured to terminate the wires to the contacts when the wire holders are coupled to the contact organizer.

18. The assembly of claim 17, wherein the contacts of each differential pair are positioned at different radial distances from the central axis of the contact organizer.

19. The assembly of claim 17, wherein the contacts of each differential pair include a base, an insulation displacement portion, and an intermediate portion extending between the base and the insulation displacement portion, the intermediate portions of the contacts of each differential pair having different lengths, the insulation displacement portions of the contacts of each differential pair having the same length.

* * * * *